US008291985B2

(12) United States Patent
Holderman

(10) Patent No.: US 8,291,985 B2
(45) Date of Patent: Oct. 23, 2012

(54) WELL ASSEMBLY WITH REMOVABLE FLUID RESTRICTING MEMBER

(75) Inventor: Luke W. Holderman, Plano, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 447 days.

(21) Appl. No.: 12/554,035

(22) Filed: Sep. 4, 2009

(65) Prior Publication Data

US 2011/0056677 A1 Mar. 10, 2011

(51) Int. Cl.
*E21B 29/00* (2006.01)

(52) U.S. Cl. ..... 166/376; 166/373

(58) Field of Classification Search ..... 166/373, 166/369, 376, 317; 137/68.11, 67
See application file for complete search history.

(56) References Cited

U.S. PATENT DOCUMENTS

| | | | | |
|---|---|---|---|---|
| 2,981,332 | A | 4/1961 | Miller et al. | |
| 3,880,233 | A | 4/1975 | Muecke et al. | |
| 3,905,423 | A | 9/1975 | Sparlin et al. | |
| 3,916,497 | A | 11/1975 | Doi et al. | |
| 4,202,411 | A | 5/1980 | Sharp et al. | |
| 5,165,476 | A | 11/1992 | Jones | |
| 5,287,923 | A * | 2/1994 | Cornette et al. | 166/278 |
| 5,310,000 | A | 5/1994 | Arterbury et al. | |
| 5,320,178 | A | 6/1994 | Cornette | |
| 6,328,112 | B1 * | 12/2001 | Malone | 166/386 |
| 6,380,136 | B1 | 4/2002 | Bates et al. | |
| 6,394,185 | B1 | 5/2002 | Constien | |
| 6,719,051 | B2 | 4/2004 | Hailey, Jr. et al. | |
| 6,764,980 | B2 | 7/2004 | Bates et al. | |
| 6,831,044 | B2 | 12/2004 | Constien | |
| 6,857,476 | B2 | 2/2005 | Richards | |
| 6,886,634 | B2 | 5/2005 | Richards | |
| 6,899,176 | B2 | 5/2005 | Hailey, Jr. et al. | |
| 7,096,945 | B2 | 8/2006 | Richards et al. | |
| 7,191,833 | B2 | 3/2007 | Richards | |
| 7,390,593 | B2 | 6/2008 | Yamamoto et al. | |
| 7,451,815 | B2 | 11/2008 | Hailey, Jr. | |

(Continued)

FOREIGN PATENT DOCUMENTS

| | | |
|---|---|---|
| GB | 233602 | 5/1925 |

(Continued)

OTHER PUBLICATIONS

"Resilient Seal Check Valve for Annular Flow Screen," electronic publication date Jun. 27, 2007 (5 pages).

*Primary Examiner* — Shane Bomar
*Assistant Examiner* — Kipp Wallace
(74) *Attorney, Agent, or Firm* — Kilpatrick Townsend & Stockton LLP

(57) ABSTRACT

Assemblies that can be disposed in a subterranean bore are described. An assembly can include a fluid restricting member in a groove. At least a portion of the fluid restricting member can be removable from the groove after being exposed to an environment of the bore to form a bypass to a tubing valve. The fluid restricting member may be positioned in a groove located between an inner wall of a base pipe and an outer wall of an assembly housing that is exterior to the base pipe. The fluid restricting member can cooperate with at least part of the tubing valve to block fluid flow and pressure equalization before at least a portion of the fluid restricting member is removed from the grove.

20 Claims, 6 Drawing Sheets

U.S. PATENT DOCUMENTS

| | | | | |
|---|---|---|---|---|
| 7,775,286 | B2 * | 8/2010 | Duphorne | 166/376 |
| 2004/0163804 | A1 * | 8/2004 | Bode et al. | 166/227 |
| 2004/0231845 | A1 | 11/2004 | Cooke, Jr. | |
| 2007/0017675 | A1 * | 1/2007 | Hammami et al. | 166/278 |
| 2007/0144731 | A1 * | 6/2007 | Murray et al. | 166/120 |
| 2007/0225175 | A1 | 9/2007 | Cooke, Jr. | |
| 2008/0015120 | A1 | 1/2008 | Cooke, Jr. | |
| 2008/0115932 | A1 | 5/2008 | Cooke, Jr. | |
| 2008/0135249 | A1 | 6/2008 | Fripp et al. | |
| 2009/0107684 | A1 | 4/2009 | Cooke, Jr. | |
| 2011/0162840 | A1 * | 7/2011 | Haeberle et al. | 166/278 |

FOREIGN PATENT DOCUMENTS

| | | |
|---|---|---|
| WO | WO 2005/012689 | 2/2005 |

* cited by examiner

WELL ASSEMBLY WITH REMOVABLE FLUID RESTRICTING MEMBER

TECHNICAL FIELD OF THE INVENTION

The present invention relates generally to an assembly for subterranean fluid production and, more particularly (although not necessarily exclusively), to an assembly that includes a fluid restricting member configured to be removed from a groove after the assembly is located in a wellbore.

BACKGROUND

Hydrocarbons can be produced through a wellbore traversing a subterranean formation. Various components can be located in the bore to produce hydrocarbons. For example, perforated piping can be used to receive hydrocarbons, inflow control devices can be used to control the flow of hydrocarbons from a formation to the perforated piping, and screen assemblies can be used to stabilize the formation in a production zone and to filter particulate materials from the hydrocarbons before the hydrocarbons enter the perforated piping.

Some of the components can be located or activated in the bore using pressure. For example, some of the components may respond to a pressure exceeding a selected threshold by changing configuration. A tubing valve, such as a one-way valve, may be used to prevent pressure used to configure one component from affecting other components.

In some implementations, the tubing valve may prevent post-placement treatments to certain components. For example, particulate materials, such as sand and dirt, may plug openings in the base pipe or other components. Acid can be used to remove the particulate materials from the openings after placement. The tubing valve, however, may prevent acid from being pumped to the location of the openings.

Aluminum bypass plugs have been used in perforations of production piping to prevent particulate materials from plugging the perforations. The aluminum plugs dissolve after contact with acid introduced into the bore to open the perforations. The aluminum bypass plugs, however, require the acid to be introduced into the bore and may dissolve at an unpredictable rate, depending on the amount and chemical composition of both the acid and the aluminum plugs. Furthermore, the tubing valve may prevent acid flow to the aluminum plugs.

Therefore, a mechanism for bypassing a tubing valve is desirable. A mechanism for bypassing a tubing valve without requiring an introduction of materials into the bore to cause the bypass is desirable. A mechanism for bypassing a tubing valve predictably is also desirable.

SUMMARY

Certain embodiments of the present invention are directed to assemblies that include a fluid restricting member in a groove located between an inner wall of a base pipe and an outer wall of an assembly housing that is exterior to the base pipe. The fluid restricting member may cooperate with a tubing valve or other component to restrict fluid flow and prevent pressure equalization, partially or fully. At least a portion of the fluid restricting member is removable from the groove after the fluid restricting member is exposed to an environment of a subterranean bore. The groove with at least part of the fluid restricting member removed may provide a bypass to the tubing valve or the other component. In some embodiments, the fluid restricting member is capable of degrading upon exposure to the environment of the bore and of being removed from the groove after at least partially degrading. For example, at least a portion of the fluid restricting member can be removed from the groove by fluid flow after degrading at least partially.

In one aspect, an assembly capable of being disposed in a bore is provided. The assembly includes a base pipe, an assembly housing, and a fluid restricting member. The base pipe has an inner wall defining a flow path. The assembly housing is disposed exterior to the base pipe and has an outer wall. The fluid restricting member is disposed in at least one groove between the inner wall of the base pipe and the outer wall of the assembly housing. At least a portion of the fluid restricting member is removable after exposure to an environment in the bore.

In at least one embodiment, the base pipe includes the at least one groove in an outer wall of the base pipe.

In at least one embodiment, the assembly includes a sleeve disposed exterior to at least part of the base pipe. The sleeve includes the at least one groove.

In at least one embodiment, the fluid restricting member includes at least one of polylactic acid, asphalt compounds, paraffin wax, polycaprolactone, or poly-3-hydroxybutyrate.

In at least one embodiment, the assembly housing is coupled to at least one of an inflow control device or a sand screen.

In at least one embodiment, the fluid restricting member can restrict fluid flow for a pre-selected amount of time after the fluid restricting member is exposed to the environment of the bore.

In at least one embodiment, the assembly includes an assembly sleeve disposed between the base pipe and the assembly housing. The assembly sleeve can cooperate with the fluid restricting member to restrict fluid flow for the pre-selected amount of time after the fluid restricting member is exposed to the environment of the bore.

In at least one embodiment, the assembly sleeve can cooperate with a ring to form a tubing valve. The ring includes the at least one groove.

In at least one embodiment, the assembly housing includes the at least one groove in an inner wall of the assembly housing.

In at least one embodiment, the fluid restricting member can degrade upon being exposed to the environment of the bore. At least the portion of the fluid restricting member can be removed from the at least one groove by fluid flow after the fluid restricting member degrades at least partially.

In another aspect, an assembly capable of being disposed in a bore is provided. The assembly includes a sleeve. The sleeve includes at least one groove that has a fluid restricting member disposed in the at least one groove. The sleeve can be located exterior to at least part of a base pipe. At least a portion of the fluid restricting member can be removed from the at least one groove after being exposed to an environment of the bore to form a bypass to a tubing valve.

In at least one embodiment, the sleeve is positioned substantially adjacent to the base pipe and can form a seal with the base pipe.

In at least one embodiment, the assembly includes a tubing valve that can cooperate with the fluid restricting member to form a seal before at least the portion of the fluid restricting member is removed from the at least one groove.

In at least one embodiment, the tubing valve includes a ring and an assembly sleeve. The ring can be coupled to an assembly housing. The assembly sleeve can cooperate with the fluid restricting member to restrict fluid flow at least partially before at least the portion of the fluid restricting member is removed from the at least one groove.

In another aspect, an assembly capable of being disposed in a bore is provided. The assembly includes a base pipe, an assembly housing, at least one groove, a fluid restricting member, and an assembly sleeve. The base pipe has an inner wall defining a flow path. The assembly housing is disposed exterior to the base pipe and has an outer wall. The at least one groove is positioned between the inner wall of the base pipe and the outer wall of the assembly housing. The fluid restricting member is disposed in the at least one groove. The assembly sleeve is positioned between the fluid restricting member and the assembly housing. The assembly sleeve is configured to cooperate with the fluid restricting member to restrict fluid flow at least partially. At least a portion of the fluid restricting member can be removed from the at least one groove after being exposed to an environment of the bore to allow fluid to bypass the assembly sleeve.

In at least one embodiment, the fluid restricting member can degrade a first pre-set threshold amount upon being exposed to the environment of the bore to allow fluid to bypass the assembly sleeve. At least the portion of the fluid restricting member can be removed by fluid flow after degrading a second pre-set threshold amount.

These illustrative aspects and embodiments are mentioned not to limit or define the invention, but to provide examples to aid understanding of the inventive concepts disclosed in this application. Other aspects, advantages, and features of the present invention will become apparent after review of the entire application.

DETAILED DESCRIPTION

Figure 1:
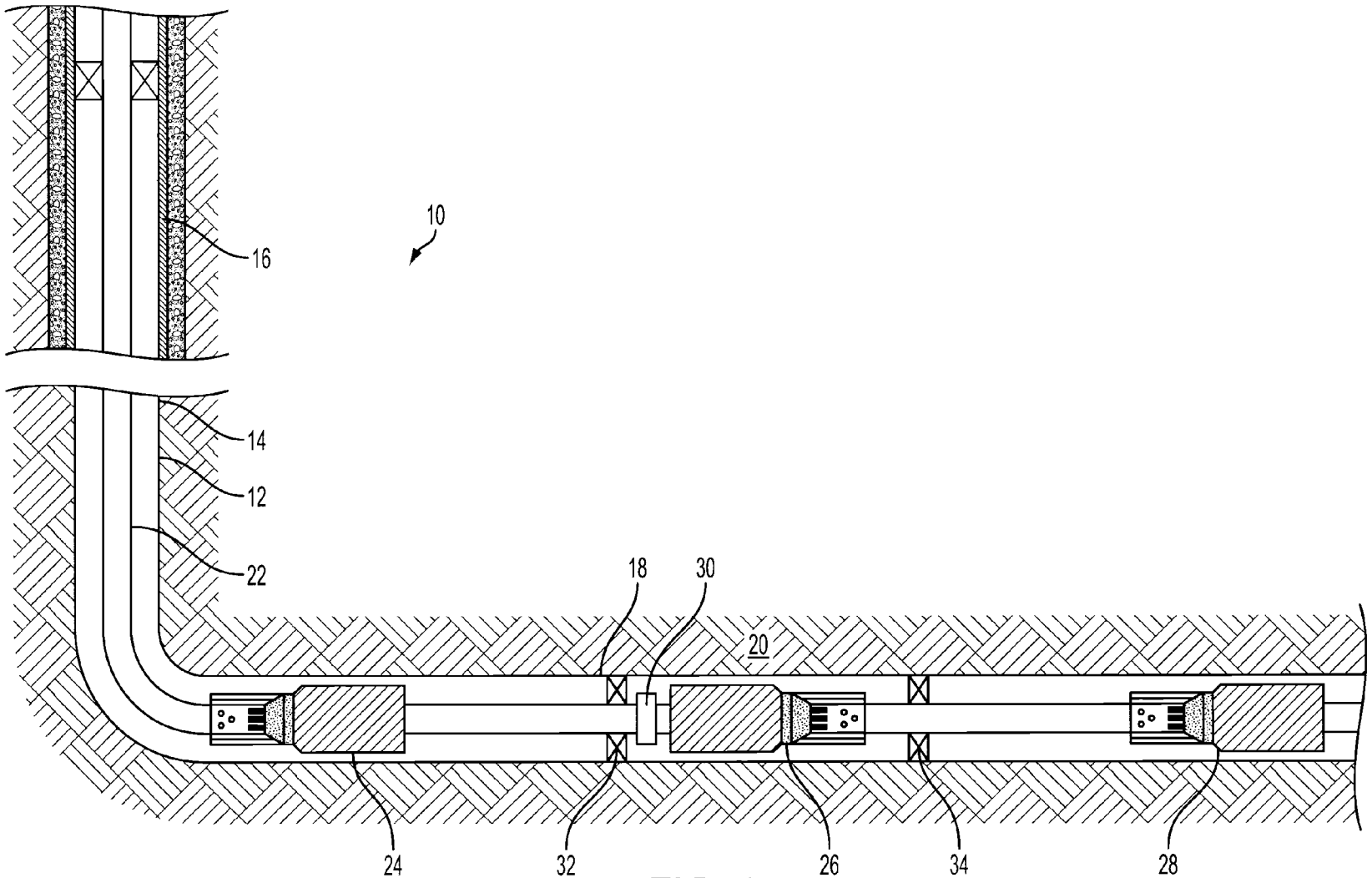
FIG. 1 is a schematic illustration of a well system having assemblies with fluid restricting members according to one embodiment of the present invention.

Certain aspects and embodiments of the present invention relate to assemblies capable of being disposed in a bore, such as a wellbore, of a subterranean formation for use in producing hydrocarbon fluids from the formation. An assembly according to certain embodiments of the present invention can include a fluid restricting member located in a groove between an inner wall of a base pipe and an outer wall of an assembly housing. The fluid restricting member can be configured to prevent fluid flow at least partially for a certain amount of time. After being exposed to an environment of the bore, at least a portion of the fluid restricting member may be removed from the groove to provide a bypass, allowing fluid to flow and pressure to equalize. The bypass may be a bypass to a tubing valve. In some embodiments, the fluid restricting member can degrade at a known or estimated rate upon being exposed to the environment of the bore and, after degrading at least partially, be removed from the groove by fluid flow or otherwise.

In some embodiments, the fluid restricting member is a material that degrades after exposure to a temperature above a certain threshold. The temperature at the location of the temporary fluid restricting member in the bore can be known. The rate of degradation of the fluid restricting member can be determined using the temperature. Examples of the material include polylactic acid (PLA), asphalt compounds, paraffin wax, polycaprolactone, and poly-3-hydroxybutyrate.

Grooves according to various embodiments of the present invention can be any shape and size that is configured to receive the fluid restricting member at least temporarily. In some embodiments, a base pipe is provided that includes one or more grooves in a portion of an exterior wall of the base pipe. In other embodiments, a sleeve capable of being located exterior to at least part of the base pipe or at least part of an assembly housing or other component may be provided that includes one or more grooves in an exterior wall of the sleeve. In some embodiments, an assembly housing exterior to a base pipe is provided that includes one or more grooves in a portion of an inner wall of the assembly housing.

The fluid restricting member may cooperate with an assembly sleeve, a valve, or another structure before degrading a certain amount to restrict fluid flow and to prevent pressure from affecting certain components. Restricting fluid flow can include partially or fully preventing fluid flow. Other components, such as packers, can be located or otherwise set in the bore using pressure, and the fluid restricting member cooperating with the assembly sleeve can prevent the pressure from affecting other components. After the packers, for example, are set, the fluid restricting member can be configured to degrade and to be removed by fluid flow or otherwise to provide a bypass for fluid and pressure around the assembly sleeve. In some embodiments, the fluid restricting member can degrade after being exposed to an environment of the bore by dissolving, melting, or otherwise changing configuration.

FIG. 1 shows a well system 10 with assemblies according to certain embodiments of the present invention. The well system 10 includes a bore that is a wellbore 12 that extends through various earth strata. The wellbore 12 has a substantially vertical section 14 and a substantially horizontal section 18. The substantially vertical section 14 includes a casing string 16 cemented at an upper portion of the substantially vertical section 14. The substantially horizontal section 18 is open hole and extends through a hydrocarbon bearing subterranean formation 20.

A tubing string 22 extends from the surface within wellbore 12. The tubing string 22 can provide a conduit for formation fluids to travel from the substantially horizontal section 18 to the surface. Assemblies 24, 26, 28 are positioned with the tubing string 22 in the substantially horizontal section 18. Each of the assemblies 24, 26, 28 includes a base pipe with perforations to receive hydrocarbon fluid, an assembly sleeve, and an assembly housing. Each of the assemblies 24, 26, 28 also includes one or more grooves that each can receive a fluid restricting member. In some embodiments, each of assemblies 24, 26, 28 includes a sand control screen, inflow control device, or other component configured to assist in hydrocarbon fluid production.

Tubing strings according to various embodiments of the present invention, however, may include any number of other tools and systems in addition to assemblies 24, 26, 28. Examples of other tools and systems include communication systems, safety systems, couplings, and zonal isolation devices such as packers. For example, assemblies 24, 26 are illustrated as being separated by a coupling 30 positioned with the tubing string. Packer 32 is positioned with the tubing string between assembly 24 and assembly 26. Packer 34 is positioned between assembly 26 and assembly 28. Packers 32, 34 may be zonal isolation devices that are made from materials capable of expanding upon contact with a fluid or upon exposure to a pressure above a certain threshold. For example, packers 32, 34 may be set after the assemblies 24, 26, 28 are located in the wellbore 12. The fluid restricting members can be configured to prevent pressure introduced in setting the packers 32, 34 from affecting other components located in the wellbore 12 and, after a suitable amount of time, be removed from the grooves by fluid flow or otherwise. In some embodiments, the fluid restricting members are configured to degrade after exposure to an environment of the bore and be removed from the grooves after degrading at least partially.

FIG. 1 shows assemblies according to certain embodiments of the present invention in the substantially horizontal section 18 of the wellbore 12. Various screen assembly embodiments according to the present invention, however, can be used in deviated, vertical, or multilateral wellbores. Deviated wellbores may include directions different than, or in addition to, a general horizontal or a general vertical direction. Multilateral wellbores can include a main wellbore and one or more branch wellbores. Directional descriptions are used herein to describe the illustrative embodiments but, like the illustrative embodiments, should not be used to limit the present invention.

Certain embodiments of the present invention can be disposed in an injection well. In an injection well, water or other fluid is injected into the well to increase flow of hydrocarbon fluids to a nearby production well. Assemblies according to certain embodiments of the present invention can be disposed in the injection well to provide a temporary block to fluid when the components are set into the injection well.

Assemblies according to some embodiments of the present invention can be disposed in a cased hole completion. In a cased hole completion, a large diameter pipe is positioned between a production string and a formation. The large diameter pipe may be a base pipe with openings in a sidewall portion of the base pipe. An assembly can be positioned exterior to the large diameter pipe. The assembly can include one or more grooves with a fluid restricting member located in each of the grooves. The fluid restricting member can be configured to at least partially restrict fluid flow and to prevent pressure from affecting certain assembly components independently or in cooperation with an assembly sleeve or otherwise a one-way valve. The fluid restricting member may degrade at a certain rate upon exposure to an environment and, after degrading a certain amount, be removed from the groove by fluid flow to allow fluid flow and pressure to equalize among two or more assembly components.

Assemblies according to some embodiments of the present invention may include a control line that can be a fiber optic cable in communication with a sensor capable of contacting a fluid restricting member or a formation. The control line can detect conditions associated with the fluid restricting member or the formation and can transmit information about the conditions to the surface for analysis.

Figure 2:
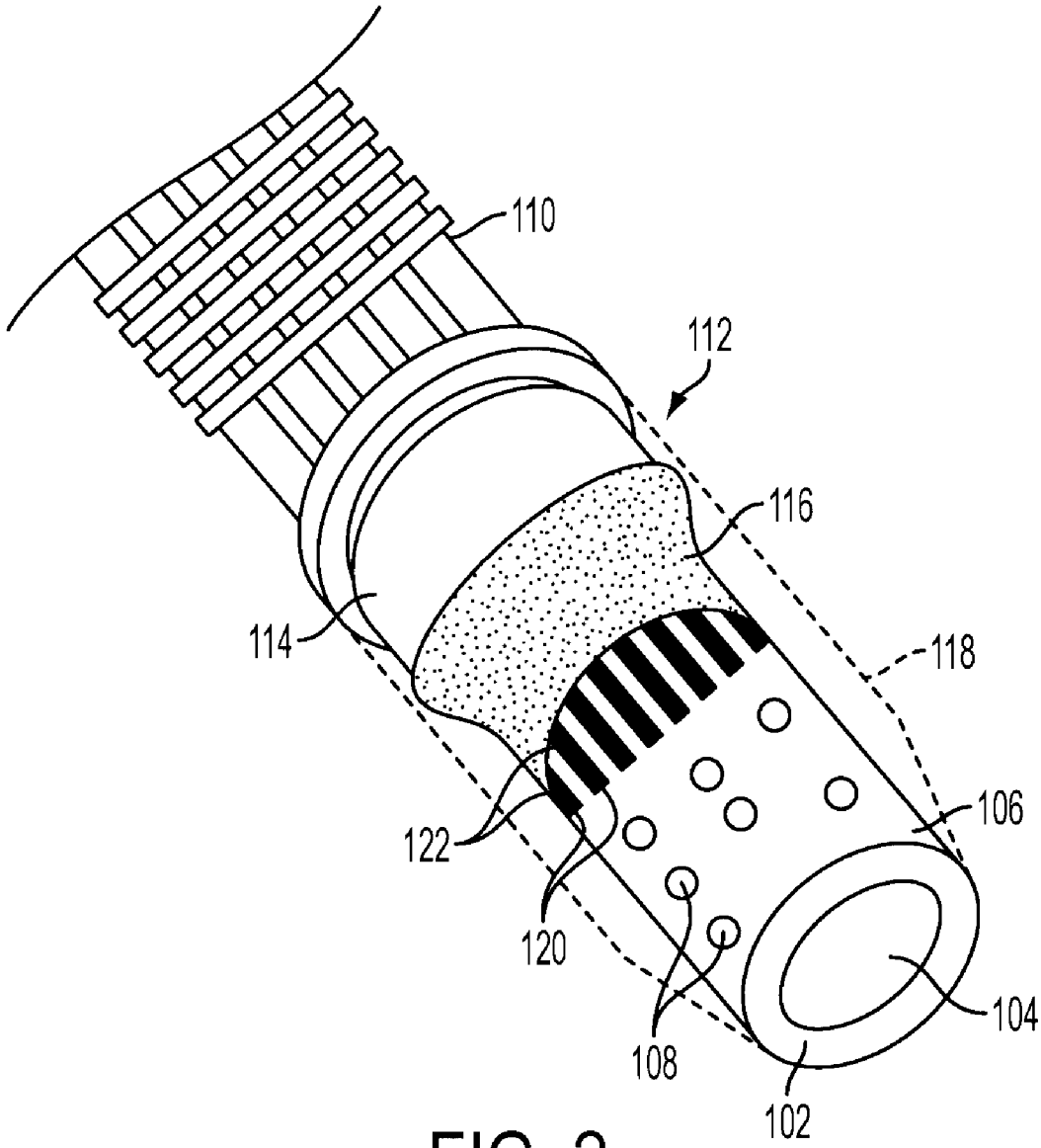
FIG. 2 is a perspective view of an assembly with a screen according to one embodiment of the present invention.

FIG. 2 shows a more detailed view of an assembly, such as one of the assemblies 24, 26, 28, according to one embodiment of the present invention. The assembly includes a base pipe 102 having an inner wall defining an internal flow path 104 and having an outer wall 106. The outer wall 106 includes perforations 108 that are openings forming a conduit to allow hydrocarbon fluids to flow to the internal flow path 104 and fluid to flow from the internal flow path 104. A screen subassembly 110 is located circumferential to part of the base pipe 102. The screen subassembly 110 can be configured to filter particulate material from hydrocarbon fluid produced by a formation and to provide stability to the formation at the production interval. Although FIG. 2 illustrates a screen subassembly 110, other devices, such as an inflow control device, can be used with the screen subassembly 110 or as alternatives to the screen subassembly 110.

The assembly in FIG. 2 also includes a tubing valve 112. The tubing valve 112 includes a ring 114 and an assembly sleeve 116. The ring 114 may provide a seal for the tubing valve with assembly housing 118. Assembly housing 118 is represented using a dotted line in FIG. 2 to allow the components covered by the assembly housing 118 to be viewed. The assembly sleeve 116 can extend from the ring 114 to the base pipe 102 and can provide a seal with the base pipe 102.

The assembly can include grooves 120. The grooves 120 are shown at a location of the base pipe 102 to which the assembly sleeve 116 extends. In other embodiments, the grooves 120 are positioned in other locations of the assembly, such as any location between an inner wall of the base pipe 102 and an outer wall of the assembly housing 118. For example, the grooves 120 may be located on or substantially adjacent to the assembly housing 118, ring 114, or assembly sleeve 116.

The grooves 120 can receive fluid restricting members 122. The fluid restricting members 122 may be degradable materials that can at least partially restrict fluid flow and prevent pressure from affecting certain components and that can degrade after being exposed to an environment of a bore. In some embodiments, the fluid restricting members 112 cooperate with the assembly sleeve 116 to restrict at least partially fluid flow and pressure from affecting certain components. In some embodiments, the fluid restricting members 112 can be removed from the grooves 120 by fluid flow, such as a flow of fluids present in the bore or of fluids introduced into the bore, after degrading a certain amount. The grooves 120 with fluid restricting members 112 removed can provide a bypass to the tubing valve 112 to allow fluid to flow from one side of assembly sleeve 116 to the other side of the assembly sleeve 116 and to allow pressure to equalize on both sides of the assembly sleeve 116.

The fluid restricting members 122 may be any material that can degrade, such as by changing configuration in response to being exposed to one or more characteristics of the environment of the bore. In some embodiments, the fluid restricting members 122 are in a brittle, but solid, configuration before exposure to the environment of the bore. Upon exposure to a temperature characteristic of the environment, for example, the fluid restricting members 122 can change configuration from a brittle, but solid, configuration to a wax-like configuration or a liquid configuration. In some embodiments, the fluid restricting members 122 can melt, such as by changing from a substantially solid state to at least a partly liquid or gaseous state at a specified rate upon exposure to temperature, pressure, and/or moisture of a subterranean bore environment. A substantially solid state can include matter that is malleable or brittle, but otherwise is capable of preventing pressure from equalizing fully across the material or fluid to flow at least fully. Examples of the fluid restricting members 122 include polylactic acid (PLA), asphalt compounds, paraffin wax, polycaprolactone, and poly-3-hydroxybutyrate.

Figure 3A:
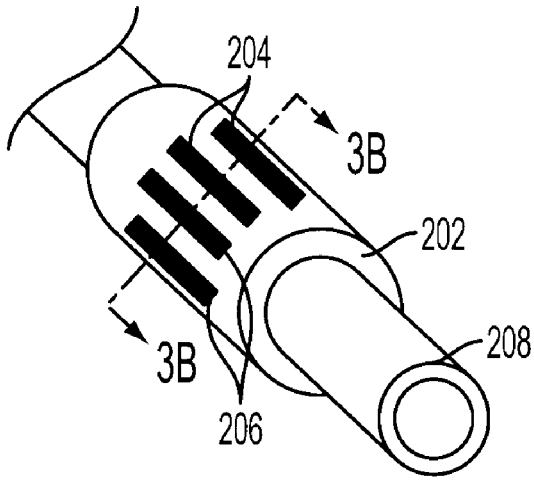
FIG. 3A is a perspective view of fluid restricting members in a grooved sleeve exterior to a base pipe according to one embodiment of the present invention.

Assemblies according to various embodiments of the present invention can include grooves in a variety of configurations for receiving fluid restricting members. FIG. 3A depicts a sleeve 202 that includes fluid restricting members 204 received in grooves 206. The sleeve 202 is positioned circumferential to a portion of a base pipe 208 exterior. A tubing valve (not shown) may be provided that can cooperate with the fluid restricting members 204 to block fluid flow and pressure equalization from one end of the grooves 206 to a second end of the grooves 206. The fluid restricting members 204 can include a degradable material that degrades at a specified rate upon exposure to an environment of a bore. Sleeves according to various embodiments can be made from any material. Examples of material include rubber compounds, polymers, and metallic materials.

Figure 3B:
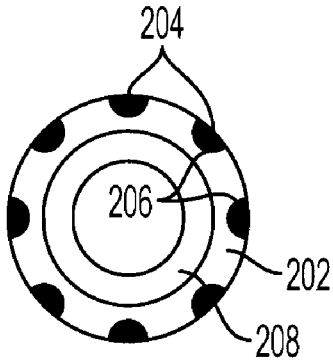
FIG. 3B is a cross-sectional view of the grooved sleeve of FIG. 3A.

FIG. 3B depicts a cross-sectional view along line A-A of the sleeve 202 of FIG. 3A that includes grooves 206 located exterior to a portion of the base pipe 208. In some embodiments, the sleeve 202 contacts the base pipe 208 to form a seal between the sleeve 202 and the base pipe 208. Grooves 206 can be formed in the sleeve 202 by removing a portion of the sleeve 202 or using a mold that provides for the grooves 206. Each of the grooves 206 can receive one of the fluid restricting members 204. FIG. 3B shows grooves 206 that do not extend through the entire cross-sectional portion of the sleeve 202. In other embodiments, the grooves 206 extend through the entire cross-sectional portion of the sleeve 202. Although FIGS. 3A and 3B depict multiple grooves, where each of the grooves is capable of receiving a fluid restricting member, sleeves according to certain embodiments of the present invention may include any number of grooves, including one groove, capable of receiving a fluid restricting member. FIGS. 3A and 3B also depict grooves 206 having a substantially semi-circular cross-sectional shape and a substantially rectangular surface shape. However, grooves according to various embodiments of the present invention can have any desired shape, surface shape and cross-sectional shape, and be any desired size.

Furthermore, FIGS. 3A and 3B depict grooves 206 in an outer surface of the sleeve 202. In other embodiments, a sleeve is provided that include grooves in an inner surface of the sleeve. Each of the grooves can receive a fluid restricting member. The fluid restricting member may cooperate with an outer surface of a base pipe, a tubing valve, or other component to at least partially restrict fluid flow and pressure equalization.

The fluid restricting members 204 can be removed from the grooves 206 by fluid flow after a certain amount of time of being exposed to an environment of the bore. In some embodiments, the fluid restricting members 204 degrade after exposure to an environment of the bore. For example, the fluid restricting members 204 may degrade at an exponential or other non-linear rate where the rate of degradation is comparatively small at a beginning of the degrading process and becomes comparatively large over time in the degrading process. At a first threshold point during the degrading process, the fluid restricting members 204 can degrade a sufficient amount to allow pressure to equalize and to allow fluid to flow across the fluid restricting members 204. Fluid can include both liquids and gasses. At a second threshold point during the degrading process, the fluid restricting members 204 can degrade a sufficient amount such that fluid flow can cause the fluid restricting members 204 to be removed from the grooves 206. In some embodiments, the first threshold and the second threshold are the same threshold point during the degrading process. In other embodiments, the first threshold is prior in time to the second threshold during the degrading process.

Figure 4A:
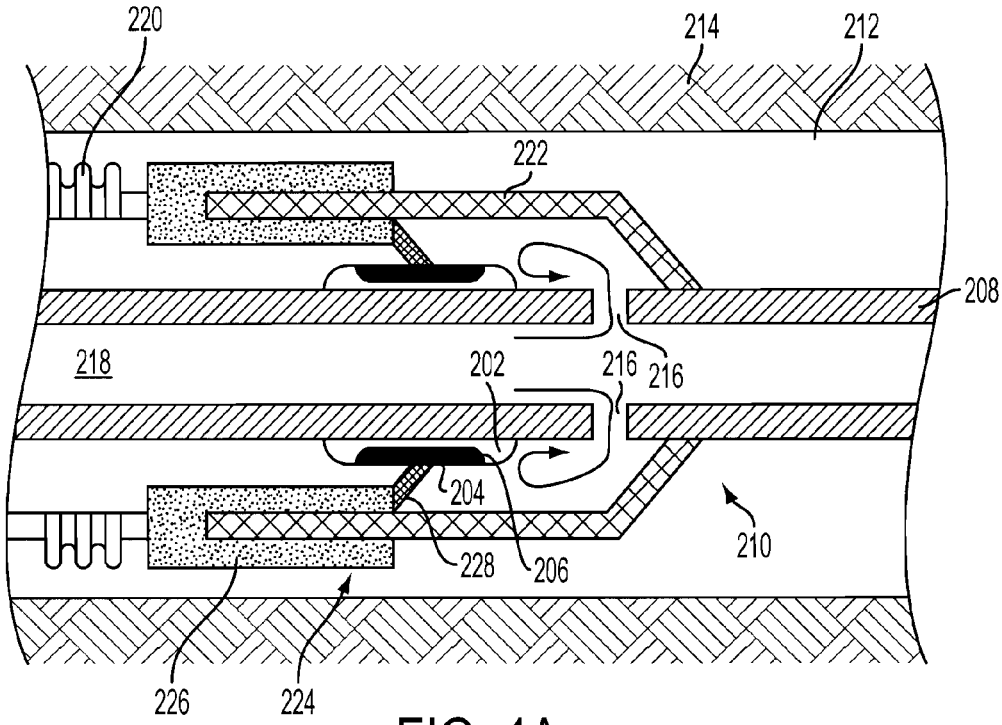
FIG. 4A is a cross-sectional view of an assembly with fluid restricting members in a grooved sleeve restricting fluid flow according to one embodiment of the present invention.
Figure 4B:
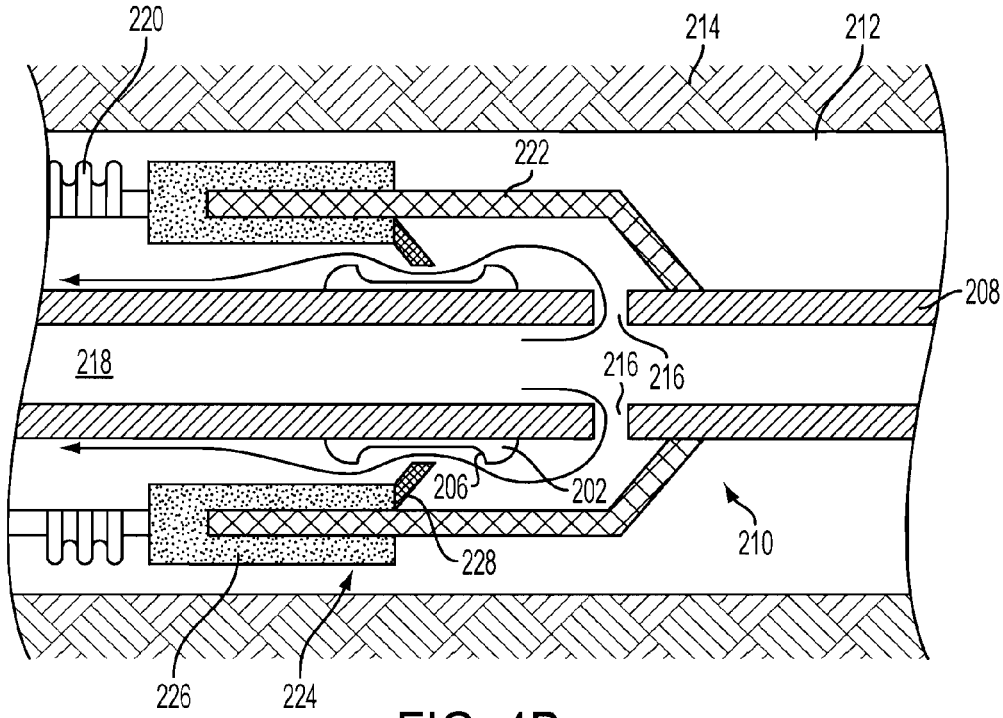
FIG. 4B is a cross-sectional view of the assembly of FIG. 4A with fluid restricting members removed from the grooved sleeved according to one embodiment of the present invention.

FIGS. 4A and 4B depict a cross-section of the sleeve 202 in an assembly 210 located in a bore 212 of a subterranean formation 214. The assembly 210 includes the base pipe 208 having perforations 216 to allow fluid communication to an internal flow path 218. The sleeve 202 is located exterior to a portion of the base pipe 208. A screen 220 is located exterior to a second portion of the base pipe 208. Screen 220, however, may be any device disposed in the bore 212 to assist hydrocarbon fluid production. In some embodiments, the assembly 210 does not include the screen 220 or any similar device.

An assembly housing 222 cooperates with a tubing valve 224 and the base pipe 208 to direct hydrocarbon fluid to the internal flow path 218 during hydrocarbon production. The assembly housing 222 can be constructed from any material that is capable of sustaining its solid state and general shape upon exposure to an environment in the bore 212. The tubing valve 224 is positioned exterior to a third portion of the base pipe 208. The tubing valve 224 includes a ring 226 and an assembly sleeve 228 that are configured to cooperate with the fluid restricting members 204 in grooves 206 to restrict, partially or fully, fluid flow and prevent, partially or fully, pressure equalization between one end of the tubing valve 224 and a second end of the tubing valve 224, as depicted by arrowed lines in FIG. 4A. The ring 226 may be made from any material that is capable of retaining a solid state and a general shape upon exposure to an environment in the bore 212. The assembly sleeve 228 may be made from any material configured to restrict at least partially fluid flow and prevent at least partially pressure equalization. Examples of material from which assembly sleeve 228 can be made include rubber compounds, polymers, and metals.

The fluid restricting members 204 may be removable after exposure to an environment of the bore. In some embodiments, the fluid restricting members 204 are configured to degrade after exposure to an environment of the bore and to be removed from the grooves by fluid flow after degrading at least partially. FIG. 4B depicts the assembly 210 having fluid restricting members 204 removed from grooves 206. The grooves 206 with the fluid restricting members 204 removed provide a bypass to the tubing valve 224 for fluid to flow and pressure to equalize as depicted by the arrowed lines in FIG. 4B.

Figure 5A:
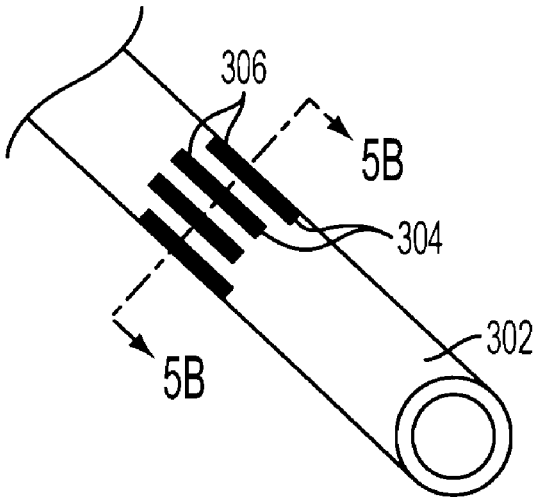
FIG. 5A is a perspective view of fluid restricting members in grooves of a base pipe according to one embodiment of the present invention.
Figure 5B:
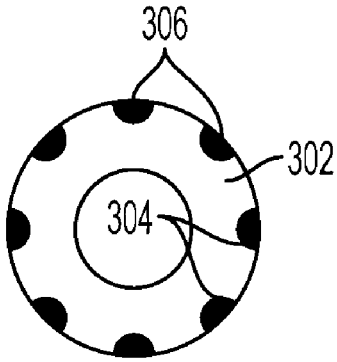
FIG. 5B is a cross-sectional view of the grooved base pipe of FIG. 5A.

A second groove configuration is shown in FIGS. 5A and 5B. A base pipe 302 is shown that includes grooves 304 in an exterior wall of the base pipe 302. Fluid restricting members 306 are located in the grooves 304. The fluid restricting members 306 may be a material that is removable after being exposed to an environment of the bore. In some embodiments, the fluid restricting members 306 are configured to degrade at a specified rate upon exposure to an environment of a subterranean bore and be removed by fluid flow or otherwise after degrading at least partially. Grooves 304 may be formed in the base pipe 302 by removing a portion of the base pipe 302 or by manufacturing a base pipe 302 using a mold that forms the grooves 304.

FIG. 5B depicts a cross-section along line B-B of FIG. 5A. Grooves 304 extend through part of entire cross-section of the base pipe 302, but not the entire cross-section. In other embodiments, the grooves 304 extend the entire cross-section of the base pipe 302 and are configured to be perforations in the base pipe 302 for receiving hydrocarbon fluids after the fluid restricting members 306 are removed from the grooves 304. FIGS. 5A and 5B depict multiple grooves where each of the grooves is capable of receiving a fluid restricting member. Base pipes according to some embodiments, however, may include any number of grooves, including one groove, capable of receiving a fluid restricting member and may be any desired shape or size.

Figure 6A:
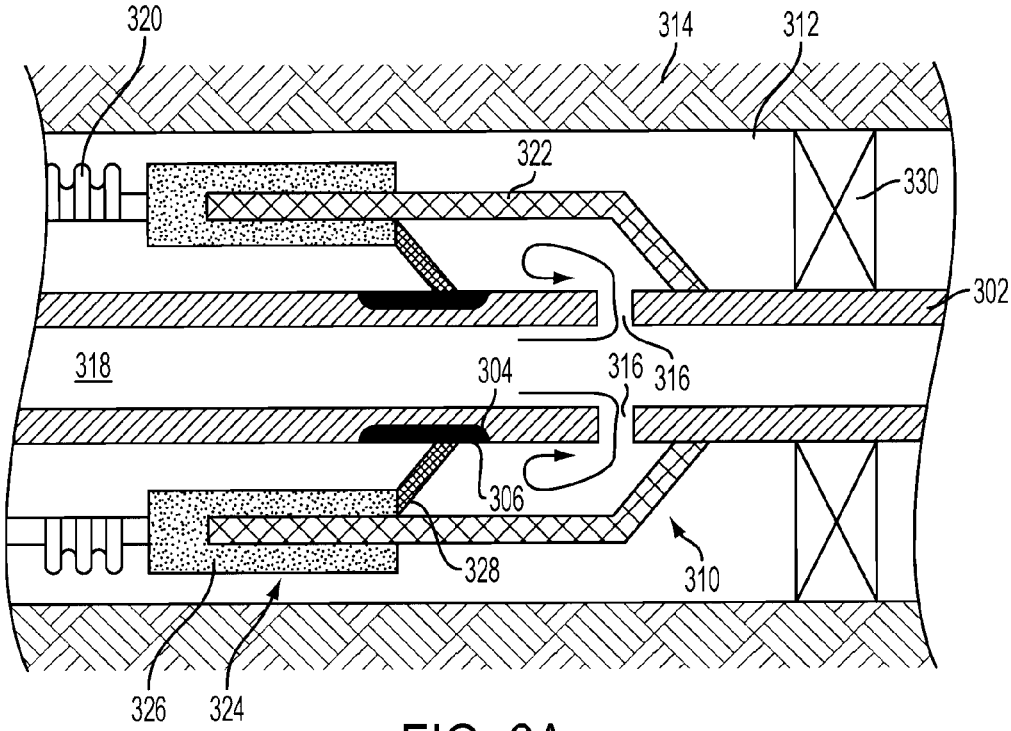
FIG. 6A is a cross-sectional view of an assembly with fluid restricting members in a grooved base pipe that are restricting fluid flow according to one embodiment of the present invention.
Figure 6B:
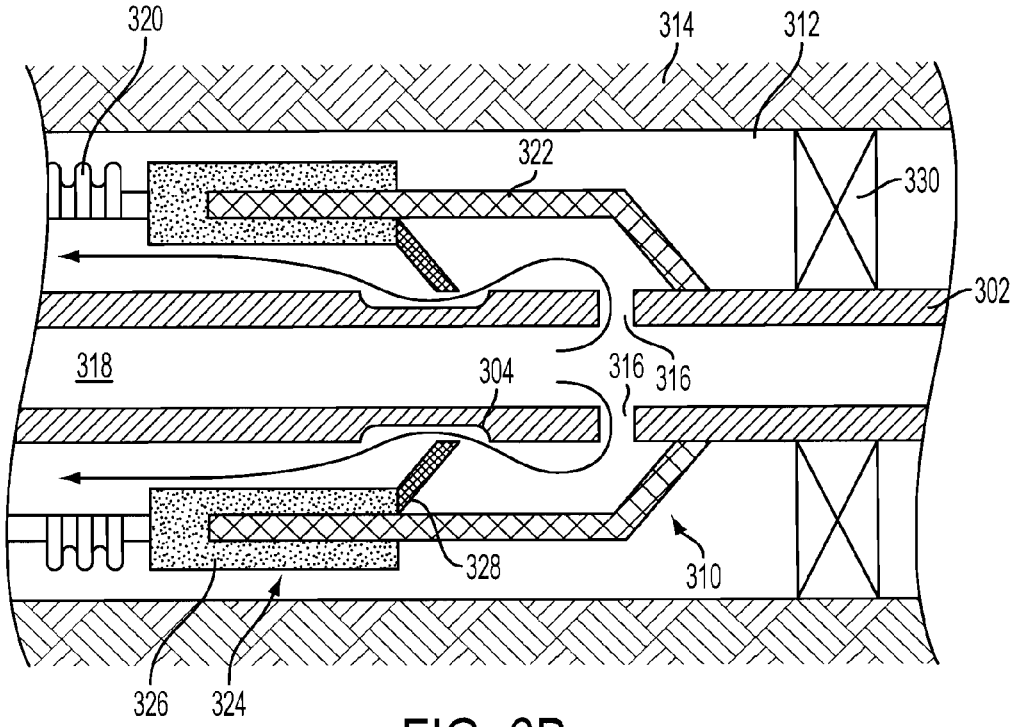
FIG. 6B is a cross-sectional view of the assembly of FIG. 6A with fluid restricting members removed from the base pipe grooves according to one embodiment of the present invention.

FIGS. 6A and 6B depict an assembly 310 that includes the base pipe 302 disposed in a bore 312 of a formation 314. The base pipe 302 includes grooves 304 located at a first portion of an outer wall of the base pipe 302 and includes perforations 316. The perforations 316 allow fluid to flow to an internal flow path 318 and from the internal flow path 318. A screen 320 is located exterior to a second portion of the base pipe 302. Although a screen 320 is depicted, any device can be disposed in the bore 312 to assist hydrocarbon fluid production. In some embodiments, the assembly 310 does not include the screen 320 or any similar device.

An assembly housing 322 cooperates with a tubing valve 324 and the base pipe 302 to direct hydrocarbon fluid to the internal flow path 318 during hydrocarbon production. The tubing valve 324 is positioned exterior to a third portion of the base pipe 302. The tubing valve 324 includes a ring 326 and an assembly sleeve 328 that are configured to cooperate with the fluid restricting members 306 in grooves 304 to restrict at least partially fluid flow and prevent at least partially pressure equalization between one end of the tubing valve 324 and a second end of the tubing valve 324, as depicted by arrowed lines in FIG. 6A.

For example, packer 330 can be set using pressure or otherwise when the fluid restricting members 306 are located in the grooves 304. The fluid restricting members 306 can cooperate with the tubing valve 324, such as by cooperating with the assembly sleeve 328, to prevent pressure introduced to set the packer 330 from affecting components or flow through the assembly 310.

The fluid restricting members 306 may be removable after exposure to an environment of the bore 312. In some embodiments, the fluid restricting members 306 may be configured to degrade at a certain rate after exposure to the environment of the bore 312 and, after degrading at least partially, configured to be removed from the grooves 304 by fluid flow. For example, the fluid restricting members 306 can be configured to degrade at a certain rate to allow the packer 330 to be set before a threshold in the degrading process at which the fluid restricting members 306 no longer restrict fluid flow or prevent pressure equalization. FIG. 6B depicts the assembly 310 with fluid restricting members 306 removed from grooves 304. The grooves 304 with the fluid restricting members 306 removed provide a bypass to the tubing valve 324 for fluid to flow and pressure to equalize as depicted by the arrowed lines in FIG. 6B.

Grooves for receiving fluid restricting members can be located at other portions of an assembly than the depicted embodiments. In some embodiments, grooves can be located at any location and associated with any component between an inner wall of a base pipe and an outer wall of an assembly housing. For example, one or more grooves can be located in an assembly sleeve of a tubing valve, a ring of a tubing valve, or an inner wall of an assembly housing. In some embodiments, grooves may be located in one or more sleeves that can be located exterior to an assembly sleeve of a tubing valve, a ring of a tubing valve, or an assembly housing. Embodiments of the present invention may include a combination of the depicted embodiments and/or grooves located in other components of an assembly. Furthermore, grooves according to various embodiments of the present invention may be any size and have any depth. For example, one or more grooves may be openings that are configured to receive fluid restricting members. In some embodiments, an assembly can include one groove that surrounds an entire circumferential portion of a base pipe, sleeve, or other assembly component.

Fluid restricting members according to various embodiments of the present invention can be any material that can change configuration based on one or more characteristics of a subterranean bore environment, such as temperature, pressure, and/or moisture, at a specified rate. These types of materials can include polylactic acid (PLA), asphalt compounds, paraffin wax, polycaprolactone, and poly-3-hydroxybutyrate. Additional examples include polyglycolic acid (PGA), polyetheretherketone (PEEK), Polycaprolactone (PCL), any suitable organic or inorganic compounds, and any combination of these or other suitable materials. In some embodiments, suitable materials can include materials having a melting temperature of between 45° C. (113° F.) to 175° C. (347° F.) at atmospheric pressure.

The foregoing description of the embodiments, including illustrated embodiments, of the invention has been presented only for the purpose of illustration and description and is not intended to be exhaustive or to limit the invention to the precise forms disclosed. Numerous modifications, adaptations, and uses thereof will be apparent to those skilled in the art without departing from the scope of this invention.

What is claimed is:

1. An assembly capable of being disposed in a bore, the assembly comprising:

a base pipe having an inner wall defining a flow path;

an assembly housing having an outer wall, the assembly housing being disposed exterior to the base pipe;

at least one groove between the inner wall of the base pipe and the outer wall of the assembly housing; and a fluid restricting member disposed in the at least one groove, at least a portion of the fluid restricting member being removable from the at least one groove by exposure to a naturally occurring environment in the bore, wherein the at least one groove is configured to provide a flow path for fluid between the inner wall of the base pipe and the outer wall of the assembly housing subsequent to the portion of the fluid restricting member being removed from the at least one groove.

2. The assembly of claim 1, wherein the base pipe comprises the at least one groove in an outer wall of the base pipe.

3. The assembly of claim 1, further comprising a sleeve disposed exterior to at least part of the base pipe, the sleeve comprising the at least one groove.

4. The assembly of claim 1, wherein the fluid restricting member comprises at least one of:

polylactic acid;

asphalt compounds;

paraffin wax;

polycaprolactone; or poly-3-hydroxybutyrate.

5. The assembly of claim 1, wherein the assembly housing is coupled to at least one of an inflow control device or a sand screen.

6. The assembly of claim 1, wherein the fluid restricting member is configured to restrict fluid flow for a pre-selected amount of time after the fluid restricting member is exposed to the environment of the bore.

7. The assembly of claim 6, further comprising an assembly sleeve disposed between the base pipe and the assembly housing, the assembly sleeve being configured to cooperate with the fluid restricting member to restrict fluid flow for the pre-selected amount of time after the fluid restricting member is exposed to the environment of the bore.

8. The assembly of claim 7, wherein the assembly sleeve is capable of cooperating with a ring to form a tubing valve, wherein the ring comprises the at least one groove.

9. The assembly of claim 1, wherein the assembly housing comprises the at least one groove in an inner wall of the assembly housing.

10. The assembly of claim 1, wherein the fluid restricting member is configured to degrade upon being exposed to the environment of the bore, wherein at least the portion of the fluid restricting member is removable from the at least one groove by fluid flow after the fluid restricting member degrades at least partially.

11. An assembly capable of being disposed in a bore, the assembly comprising:

a sleeve comprising at least one groove having a fluid restricting member disposed in the at least one groove, wherein the sleeve is capable of being located exterior to at least part of a base pipe, wherein at least a portion of the fluid restricting member is capable of being removed from the at least one groove after being exposed to an environment of the bore, wherein the at least one groove is configured to form a bypass to a tubing valve subsequent to the portion of the fluid restricting member being removed from the at least one groove, the bypass being configured to provide a flow path for fluid, wherein the tubing valve comprises a ring and an assembly sleeve, the ring being coupled to an assembly housing, the assembly sleeve being configured to cooperate with the fluid restricting member to restrict fluid flow at least partially before at least the portion of the fluid restricting member is removed from the at least one groove.

12. The assembly of claim 11, wherein the sleeve is positioned substantially adjacent to the base pipe and is configured to form a seal with the base pipe.

13. The assembly of claim 11, wherein the fluid restricting member comprises at least one of:

polylactic acid;

asphalt compounds;

paraffin wax;

polycaprolactone; or poly-3-hydroxybutyrate.

14. The assembly of claim 11, further comprising:

the tubing valve configured to cooperate with the fluid restricting member to form a seal before at least the portion of the fluid restricting member is removed from the at least one groove.

15. The assembly of claim 11, wherein the fluid restricting member is configured to restrict fluid flow for a pre-selected amount of time after the fluid restricting member is exposed to the environment of the bore.

16. An assembly capable of being disposed in a bore, the assembly comprising:

a base pipe having an inner wall defining a flow path;

an assembly housing having an outer wall, the assembly housing being disposed exterior to the base pipe;

at least one groove positioned between the inner wall of the base pipe and the outer wall of the assembly housing;

a fluid restricting member disposed in the at least one groove;

an assembly sleeve positioned between the fluid restricting member and the assembly housing, the assembly sleeve being capable of cooperating with the fluid restricting member to restrict fluid flow at least partially, wherein at least a portion of the fluid restricting member is capable of being removed from the at least one groove after being exposed to a naturally occurring environment of the bore, wherein the at least one groove is configured to provide a flow path to allow fluid to bypass the assembly sleeve subsequent to the portion of the fluid restricting member being removed from the at least one groove.

17. The assembly of claim 16, wherein the fluid restricting member comprises at least one of:

polylactic acid;

asphalt compounds;

paraffin wax;

polycaprolactone; or poly-3-hydroxybutyrate.

18. The assembly of claim 16, wherein the fluid restricting member is capable of degrading a first pre-set threshold amount upon being exposed to the environment of the bore to allow fluid to bypass the assembly sleeve, wherein at least the portion of the fluid restricting member is capable of being removed from the at least one groove by fluid flow after degrading a second pre-set threshold amount.

19. The assembly of claim 16, wherein the base pipe comprises the at least one groove in an outer wall of the base pipe.

20. The assembly of claim 16, further comprising a sleeve disposed exterior to at least part of the base pipe, the sleeve comprising the at least one groove.

* * * * *